US007163417B2

(12) United States Patent
Brodin

(10) Patent No.: US 7,163,417 B2
(45) Date of Patent: Jan. 16, 2007

(54) MULTI-CONDUCTOR CONNECTOR PLUG

(75) Inventor: Hans Karl Johan Brodin, Enebyberg (SE)

(73) Assignee: Atlas Copco Tools AB, Nacka (SE)

( * ) Notice: Subject to any disclaimer, the term of this patent is extended or adjusted under 35 U.S.C. 154(b) by 31 days.

(21) Appl. No.: 10/538,039

(22) PCT Filed: Dec. 5, 2003

(86) PCT No.: PCT/SE03/01898

§ 371 (c)(1),
(2), (4) Date: Jun. 8, 2005

(87) PCT Pub. No.: WO2004/054040

PCT Pub. Date: Jun. 24, 2004

(65) Prior Publication Data

US 2006/0057885 A1 Mar. 16, 2006

(30) Foreign Application Priority Data

Dec. 9, 2002 (SE) ..... 0203624

(51) Int. Cl.
*H01R 13/58* (2006.01)

(52) U.S. Cl. ..... 439/457

(58) Field of Classification Search ..... 439/457, 439/455–456, 459, 465–468, 470, 472–473, 439/582, 676

See application file for complete search history.

(56) References Cited

U.S. PATENT DOCUMENTS 4,869,686 A * 9/1989 Michaels et al. ..... 439/455
4,978,316 A * 12/1990 Yahata ..... 439/449
5,416,273 A 5/1995 Maciejewski
5,750,932 A 5/1998 Hansson
6,027,375 A 2/2000 Wu
6,878,008 B1 * 4/2005 Brancaleone ..... 439/457

FOREIGN PATENT DOCUMENTS

DE 9003247 U1 5/1990
DE 4234362 C1 12/1993
WO WO 94/1187 A1 5/1994

* cited by examiner

*Primary Examiner*—J. F. Duverne
(74) *Attorney, Agent, or Firm*—Frishauf, Holtz, Goodman & Chick, P.C.

(57) ABSTRACT

A connector plug intended for a multi-conductor cable (12) with a set o power conductors (30) and set of signal conductors (31) and comprising a casing (10) with a rear cable receiving opening (11), a number of contact elements (42, 43) connected to the power and signal conductors (30, 31) and arranged to engage contact elements on a connectable matching connector plug or jack, and a transition chamber (17) located between the rear cable receiving opening (11) and the contact elements (42, 43) and arranged to be penetrated by the power and signal conductors (30, 31), wherein a coiling core element (18, 118) is mounted in the transition chamber (17) to form separate routing paths (40, 41) for the power conductors (30) and the signal conductors (31) such that added lengths and slacks are provided in the conductors (30, 31) for absorbing length changes therein due to bending of the cable (12).

20 Claims, 3 Drawing Sheets

MULTI-CONDUCTOR CONNECTOR PLUG

This application is a U.S. National Phase Application under 35 USC 371 of International Application PCT/SE2003/001898 filed Dec. 5, 2003.

The invention relates to a connector plug for a multi-conductor cable with a set of power conductors and a set of signal conductors. The connector plug comprises a casing with a cable receiving opening at its rear end, a number of contact elements at its forward end connected to the power and signal conductors and arranged to engage contact elements on a connectable matching plug or jack, and a transition chamber located between the cable receiving opening and the contact elements and arranged to be penetrated by the power and signal conductors.

A problem concerned with previous connector plugs of the above mentioned type is the occurrence of undesired and hazardous strains to which the conductors and the contact elements are exposed to at bending related length changes of the conductors. Such length changes result in alternating pushing and tensioning forces in the conductors when handling the cable, resulting in strain exposure on the conductors and contact elements and ultimate fatigue breakdowns. It does not matter that the cable is longitudinally fixed to the connector plug casing, the separate conductors inside the cable are still exposed to this type of length changes and strain exposure at bending of the cable. This means a less reliable function and a limited service life of the connector plug.

The main object of the invention is to provide an improved connector plug of the above described type wherein the conductors and contact elements are protected from undesirable tension forces at bending of the cable.

Another object of the invention is to provide an improved connector plug suitable for connecting an electric power tool, for instance a power wrench, to a drive and control unit via a multi-conductor cable Preferred embodiments of the invention are described below with reference to the accompanying drawings.

IN THE DRAWINGS

Figure 1:
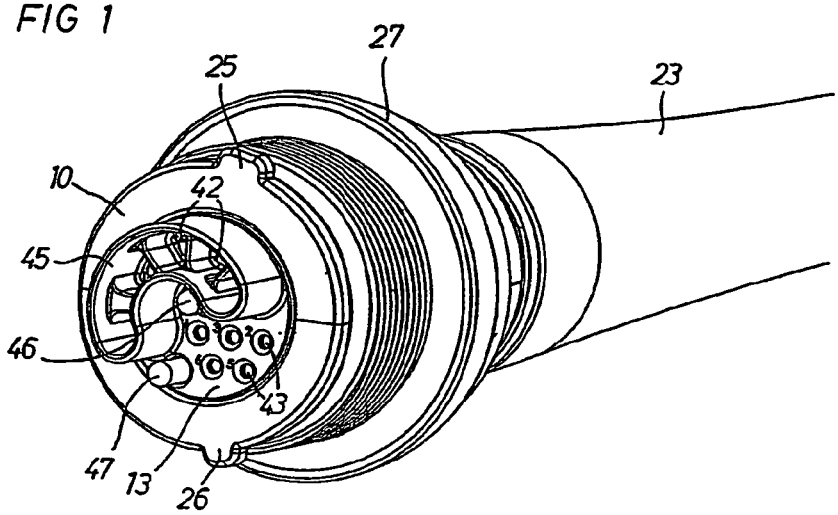
FIG. 1 shows a perspective end view of a connector plug according to the invention.

The connector plug according to the invention, as illustrated by the described examples, is suitable for connection of an electric power tool, such as a power wrench, to a separate drive and control unit. In such an application the power conductors supply electric power to the tool, whereas the signal conductors communicate operation related signals from sensors and/or maneuver means on the tool to the drive and control unit.

The connector plug shown in FIGS. 1–6 comprises a casing 10 with an open front end and a rear opening 11 for receiving a multi-conductor cable 12. In the front part of the casing 10 there is mounted a connector piece 13, a mounting member 14 for contact elements, and a conductor support plate 15, all made of a non-conducting material. The purpose of the conductor support plate 15 is to prevent bending forces in the conductors from affecting the contact elements. Depending on what type of contact elements are used, the connector piece 13 and the mounting member 14 may be formed in one piece. A sleeve portion 16 embraces and forms a mounting socket for the support plate 15. The casing 10, which in fact is longitudinally divided into two shells, comprises a transition chamber 17 for passing of the conductors of the cable 12. In the transition chamber 17 there is mounted a coiling core element 18 which is intended to accomplish added length and a slack of the conductors as described in further detail below. For practical reasons, also explained below, the coiling core element 18 is divided in two halves.

The connector piece 13, the contact element mounting member 14, the conductor support plate 15 and the coiling core element 18 are all retained between two opposite shoulders 19,20 in the casing 10. At its rear end, the casing 10 is formed with a neck portion 22 on which is received an elastic cable supporting sleeve 23. At its rear end, the neck portion 22 is formed with a hook shaped flange 24 for locking the sleeve 23 to the casing 10. See FIG. 5.

Figure 2:
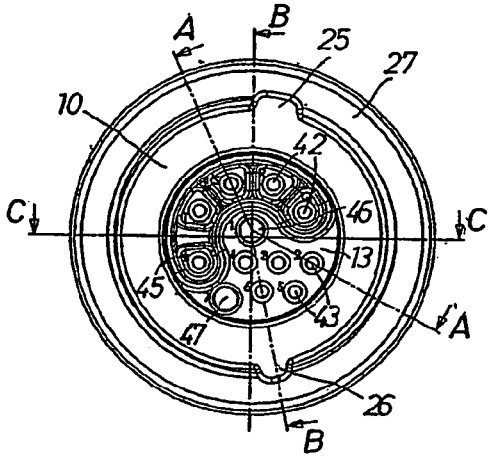
FIG. 2 shows an end view of the connector plug in FIG. 1.

At its forward end, the casing 10 is provided with two laterally directed heels 25,26 which form shoulders to be engaged by a sleeve nut 27 located on the outside of the casing 10. The sleeve nut 27 is intended to co-operate with an internally threaded socket portion of a connectable matching plug or jack (not shown) to retain the connector plug in an interconnected position relative to such jack. As can be seen in FIGS. 1 and 2, the heels 25,26 are not located diametrically opposite each other but have a slight asymmetric disposition. The heels 25,26 are arranged to co-operate with matching likewise asymmetrically located openings in a jack, thereby guaranteeing a correct angular position relative to such jack when interconnecting the two parts.

Figure 8:
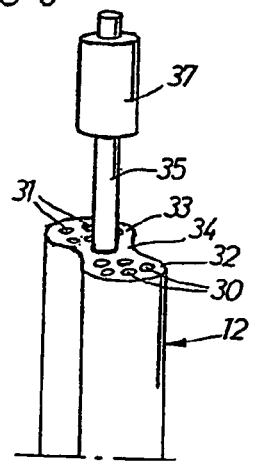
FIG. 8 shows an end part of a flat type multi-conductor cable with a tension line and a stop member, whereas for clarity the dispositions of the power and signal conductors are illustrated by circles in the end surface of the cable.
Figure 3:
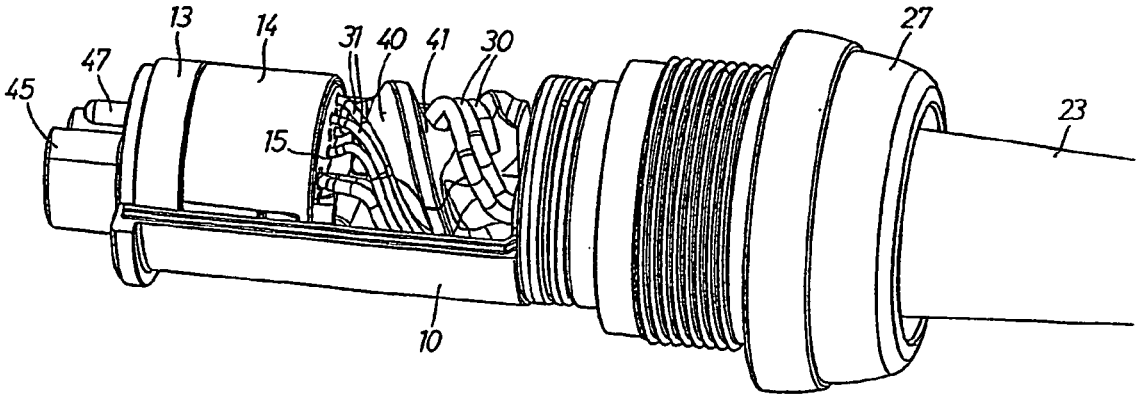
FIG. 3 shows a perspective side view of the connector plug in FIG. 1 with a part of the casing removed exposing the transition chamber and the coiling core element.
Figure 4:
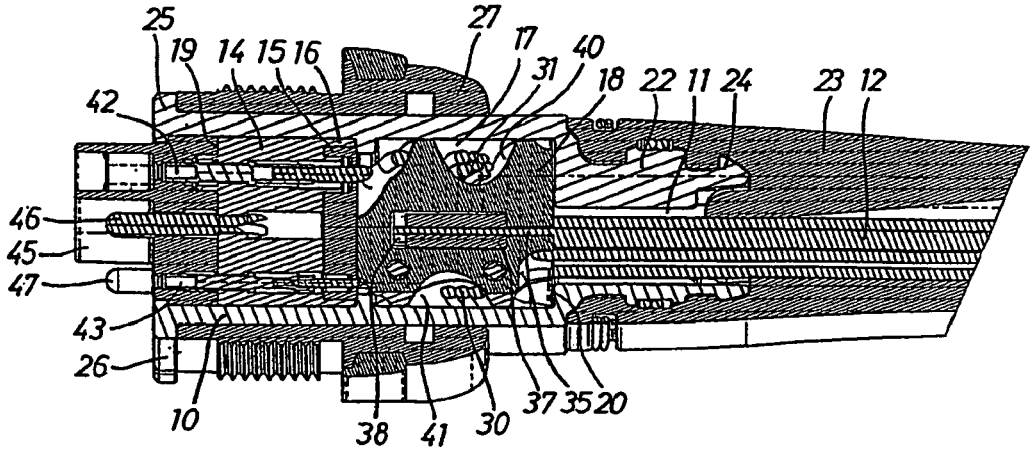
FIG. 4 shows a longitudinal section along line A—A in FIG. 2.
Figure 5:
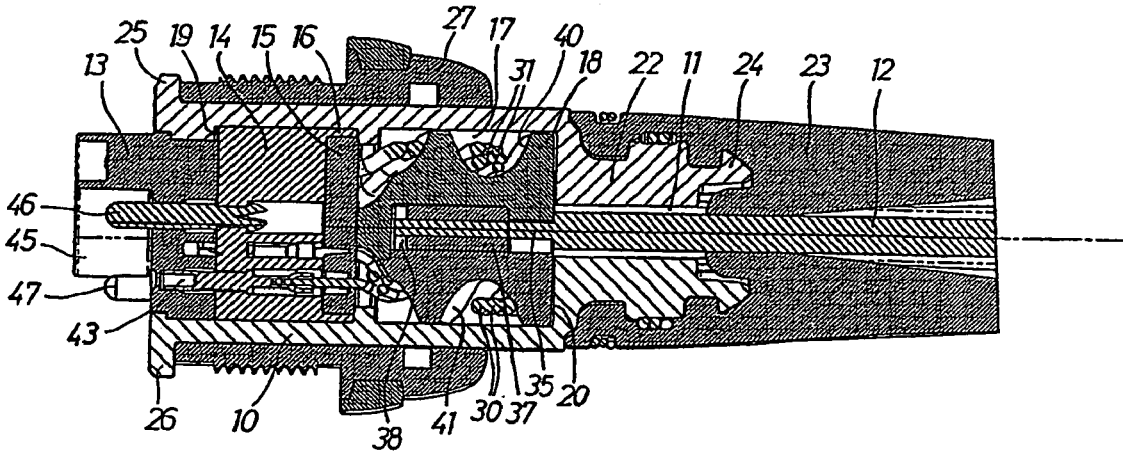
FIG. 5 shows a longitudinal section along line B—B in FIG. 2.
Figure 6:
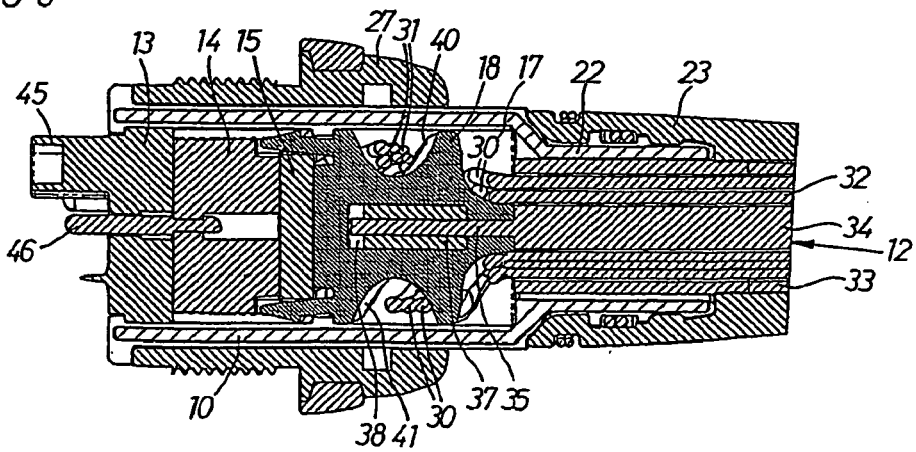
FIG. 6 shows a longitudinal section through line C—C in FIG. 2.

The cable 12 connected to the plug is a flat type cable comprising a set of big size power transmitting conductors 30 and a set of small size conductors 31 for transmitting electric signals. The cable used in the described embodiments of the invention is illustrated in FIG. 8 and further described in E.P. 0 667 980. The cable 12 comprises three sections, namely a first section 32 including the set of power transmitting conductors 30 including shielding and earth ground conductors (not specifically shown), and a second section 33 including the set of small size signal transmitting conductors 31 also including one or more non-illustrated shielding conductors. The cable 12 comprises furthermore a third intermediate section 34 including a non-conducting cable support line 35 for relieving occurring tension forces in the cable 12. The support line 35 is provided with a stop member 37 to be coupled to the coiling core element 18 via a socket portion 38 in the latter. See FIG. 8. The stop member 37 is fitted into the socket portion 38 in that the two halves of the coiling core element 18 are separated to make access to the socket portion 38 for the stop member 37. To enable this, the two shells of the casing 10 has to be separated as well. When the stop member 37 is properly located in the socket portion 38, i.e. when the two halves of the coiling core element 18 are reassembled, the casing 10 and the nut 27 will lock the halves of the coiling core element 18 together.

When passing through the transition chamber 17 the sets of power conductors 30 are kept separated from the signal conductors 31 to minimise the influence of the inevitable electric fields around the power conductors 30 on the low voltage signals transmitted through the signal conductors 31 Also from the safety point of view the high voltage power conductors are kept well separated from the low voltage signal conductors, which means that there is low risk for the signal transferring system to be exposed to a hazardous high voltage. Throughout the length of the cable 12 the power conductors 30 are separated from the signal conductors 31 by the intermediate tension line section 34, and to keep that separation through the transition chamber 17 there are provided two separate screw shaped conductor routing paths 40,41. See FIGS. 3–6. These routing paths are formed by two screw shaped channels on the coiling core element 18. This means that the set of power conductors 30 is routed through one of the screw shaped paths 41, whereas the set of signal conductors 31 is routed through the other screw shaped path 40. The two screw shaped routing paths 40,41 extend over about 360° and add a certain length to the conductor sets. Through this added length there is also provided a certain amount of slack in the conductor sets 30,31 which serves to protect the contact elements and their connection to the conductors from being exposed to tension forces due to bending of the cable. In the perspective view shown in FIG. 3 one of the casing shells are removed and the nut 27 is retracted to make visible the separated conductor routing paths 40,41 for the power conductors 30 and the signal conductors 31.

In the mounting member 14 and the connector piece 13 there are secured five contact elements 42 connected to the power conductors 30, including shielding and earth ground conductors, and five contact elements 43 connected to the signal and shielding conductors 31. All contact elements 42,43 have the form of sleeves intended to receive contact pins of a matching male type plug or jack. This means that the shown plug is a female plug. For safety reasons the power contact sleeves 42 are located inside a banana-shaped socket 45 on the front end surface of the contact piece 13.

This socket 45 is intended to protect the operator and others from the power voltage and to guide the plug during the plug-in phase. When the plug is properly interconnected with a matching male plug or jack the socket 45 is to be received in a correspondingly shaped guide recess in that jack or plug.

The plug is also provided with two code pins 46,47 which are non-conducting and intended to identify characteristics of, for instance, the voltage transferred by the cable and/or the type of power tool connected to the cable. A plug provided with one of these code pins can, for example, not be erroneously interconnected with a plug or jack having a code pin in the very same position indicating that it is connected to a power source of a different voltage or a power tool requiring a different voltage.

As to alternative plug designs, the threaded nut sleeve 27, for example, may be exchanged by a bayonet-type coupling. The code pins 46,47 may also be exchanged by connector pins as required.

Figure 7:
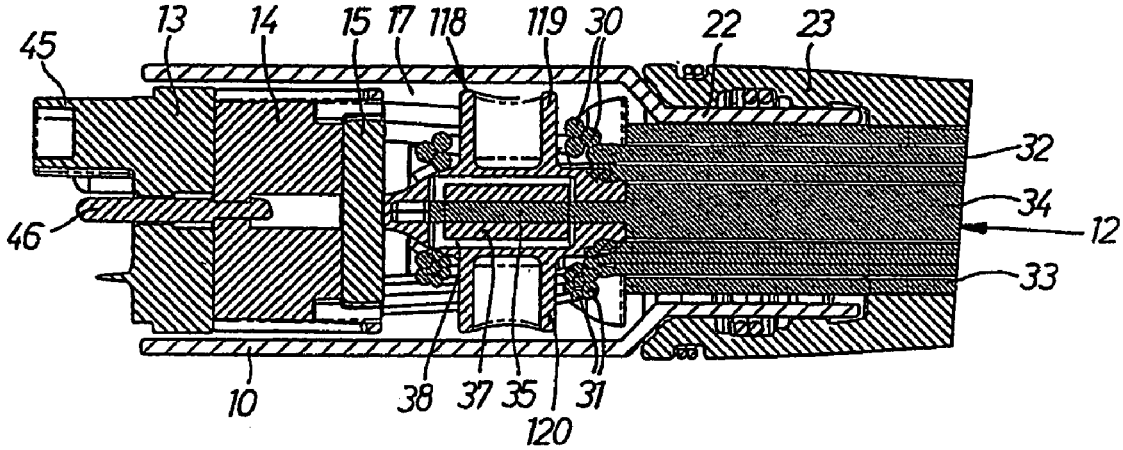
FIG. 7 shows a longitudinal section through a connector plug according to an alternative embodiment of the invention.

In FIG. 7, there is illustrated an alternative plug design wherein the coiling core element 118 is formed with two oppositely directed tubular trunnion-like studs 119,120 forming-coiling means for winding and routing separately the power conductors 30 and the signal conductors 31 through the transition chamber 17. As in the above described embodiment of the invention, the extended routing of the conductors 30,31 through the transition chamber 17 means that there is added extra length and a certain amount of slack in the conductors 30,31 to prevent tension forces to occur in the conductors and the contact elements 42,43 at bending of the cable 12.

The invention claimed is:

1. A connector plug for a multi-conductor cable including a set of power conductors and a set of signal conductors, comprising a casing with a cable receiving opening at its rear end, a number of contact elements at its forward end connected to said power conductors and said signal conductors and arranged to engage contact elements on a connectable matching connector plug or jack, and a transition chamber located in said casing between said cable receiving opening and said contact elements and penetrated by said power conductors and said signal conductors, wherein said transition chamber comprises a coiling core element mounted in said casing and forming a separate routing path for each one of said set of power conductors and said set of signal conductors, and wherein each routing path provides an added length and a slack in each one of said set of power conductors and said set of signal conductors to absorb cable bending related length changes of said power conductors and said signal conductors.

2. The connector plug according to claim 1, wherein said coiling core element comprises two oppositely located trunnion like studs, each one of said studs extends in a direction transverse to the longitudinal direction of the casing and forms a routing path defining winding core for either one of said sets of power conductors and signal conductors.

3. The connector plug according to claim 1, wherein said coiling core element comprises two screw shaped external channels extending symmetrically about an axis which extends substantially in the longitudinal direction of the casing, said channels forming said routing paths through said transition chamber.

4. The connector plug according to claim 1, wherein an anchoring device is provided for securing the cable to the casing, said anchoring device comprises a non-conductive tension wire extending throughout the cable in parallel with said power conductors and said signal conductors, and said tension wire is connected to said coiling core element.

5. The connector plug according to claim 4, wherein said anchoring device comprises a stop member rigidly secured to said tension wire, and said coiling core element is formed with a socket portion for receiving and positively locking said stop member relative to said coiling core element.

6. The connector plug according to claim 1, wherein a conductor support plate of a non-conductive material is mounted in the casing between said coiling core element and said contact elements, and said support plate is disposed in a plane transverse to the longitudinal direction of the casing and comprises a through aperture for each conductor.

7. The connector plug according to claim 6, wherein said support plate is made of a resilient material.

8. The connector plug according to claim 2, wherein an anchoring device is provided for securing the cable to the casing, said anchoring device comprises a non-conductive tension wire extending throughout the cable in parallel with said power conductors and said signal conductors, and said tension wire is connected to said coiling core element.

9. The connector plug according to claim 3, wherein an anchoring device is provided for securing the cable to the casing, said anchoring device comprises a non-conductive tension wire extending throughout the cable in parallel with said power conductors and said signal conductors, and said tension wire is connected to said coiling core element.

10. The connector plug according to claim 8, wherein said anchoring device comprises a stop member rigidly secured to said tension wire, and said coiling core element is formed with a socket portion for receiving and positively locking said stop member relative to said coiling core element.

11. The connector plug according to claim 9, wherein said anchoring device comprises a stop member rigidly secured to said tension wire, and said coiling core element is formed with a socket portion for receiving and positively locking said stop member relative to said coiling core element.

12. The connector plug according to claim 2, wherein a conductor support plate of a non-conductive material is mounted in the casing between said coiling core element and said contact elements, and said support plate is disposed in a plane transverse to the longitudinal direction of the casing and comprises a through aperture for each conductor.

13. The connector plug according to claim 3, wherein a conductor support plate of a non-conductive material is mounted in the casing between said coiling core element and said contact elements, and said support plate is disposed in a plane transverse to the longitudinal direction of the casing and comprises a through aperture for each conductor.

14. The connector plug according to claim 4, wherein a conductor support plate of a non-conductive material is mounted in the casing between said coiling core element and said contact elements, and said support plate is disposed in a plane transverse to the longitudinal direction of the casing and comprises a through aperture for each conductor.

15. The connector plug according to claim 5, wherein a conductor support plate of a non-conductive material is mounted in the casing between said coiling core element and said contact elements, and said support plate is disposed in a plane transverse to the longitudinal direction of the casing and comprises a through aperture for each conductor.

16. The connector plug according to claim 11, wherein a conductor support plate of a non-conductive material is mounted in the casing between said coiling core element and said contact elements, and said support plate is disposed in a plane transverse to the longitudinal direction of the casing and comprises a through aperture for each conductor.

17. The connector plug according to claim 12, wherein said support plate is made of a resilient material.

18. The connector plug according to claim 13, wherein said support plate is made of a resilient material.

19. The connector plug according to claim 14, wherein said support plate is made of a resilient material.

20. The connector plug according to claim 15, wherein said support plate is made of a resilient material.

* * * * *